US005398897A

United States Patent [19]

Sverdlik

[11] Patent Number: 5,398,897

[45] Date of Patent: Mar. 21, 1995

[54] RETAINER ASSEMBLY FOR STABILIZING CONTAINER HAVING A REMOVABLE LID MEMBER

[76] Inventor: David Sverdlik, 6708 Hazel St., Morton Grove, Ill. 60053

[21] Appl. No.: 104,355

[22] Filed: Aug. 9, 1993

[51] Int. Cl.[6] ..... A47G 23/02

[52] U.S. Cl. ..... 248/154; 248/146; 248/313; 248/907

[58] Field of Search ..... 248/907, 146, 154, 499, 248/313, 311.2; 211/71; 220/908

[56] References Cited

U.S. PATENT DOCUMENTS

| | | | |
|---|---|---|---|
| 2,609,103 | 9/1952 | Gravos | 248/907 X |
| 3,102,707 | 9/1963 | Jacklin | 248/907 X |
| 3,105,594 | 10/1963 | Ewers | 248/907 X |
| 3,990,654 | 11/1976 | Michael | 248/311.2 X |
| 4,527,695 | 7/1985 | Arms | 211/71 |
| 4,600,109 | 7/1986 | Schulz | 211/71 |
| 4,741,494 | 5/1988 | Voornas | 248/154 |
| 4,836,488 | 6/1989 | Ross | 248/154 X |

FOREIGN PATENT DOCUMENTS

| | | | |
|---|---|---|---|
| 1251974 | 11/1971 | United Kingdom | 248/907 X |

*Primary Examiner*—J. Franklin Foss
*Attorney, Agent, or Firm*—Neil F. Markva

[57] ABSTRACT

The retainer assembly secures a container in a free upstanding position. A rigid outwardly projecting element defines a stabilizing configuration for disposition adjacent a container at a height location intermediate the top and bottom of the upstanding container. The stabilizing configuration is effective to maintain the container in a stabilized upright position. The projecting element is adapted to connect first and second flexible tie-down lines at an outer free end line coupling section of the projecting element. The first flexible tie-down line has a length effective to extend around an outer periphery of the upstanding container and is connected to firmly maintain the container in the upright position adjacent the stabilizing configuration. A second flexible tie-down line has a length effective to extend over the removable lid member and includes a coupling device for connecting the second flexible line to firmly maintain the lid member on the container.

20 Claims, 4 Drawing Sheets

FIG. 1
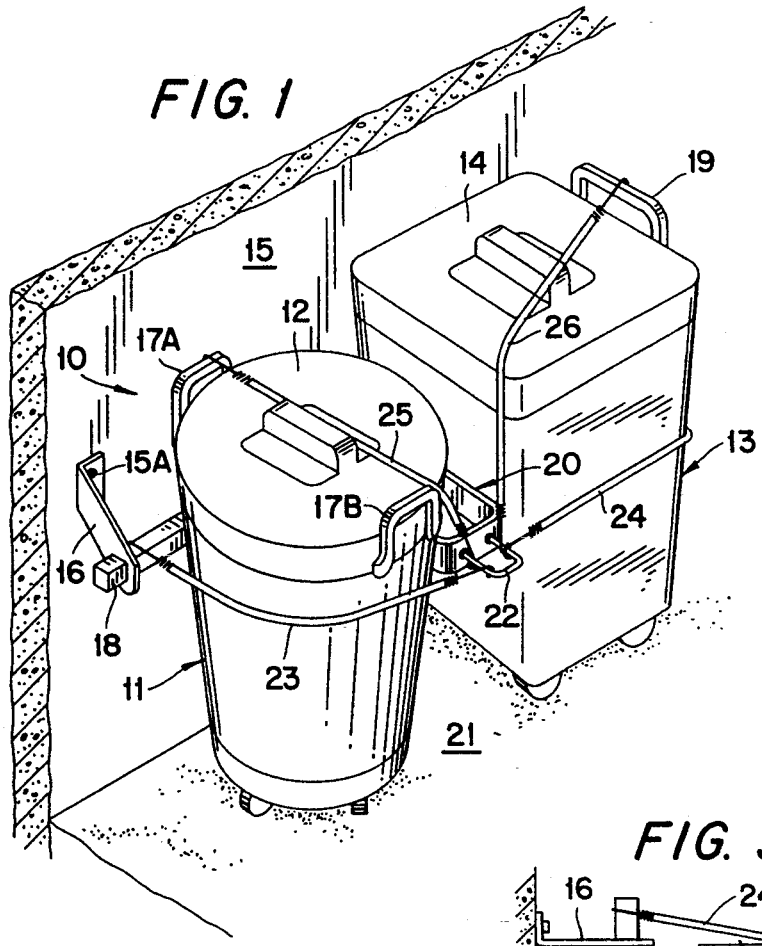
FIG. 3
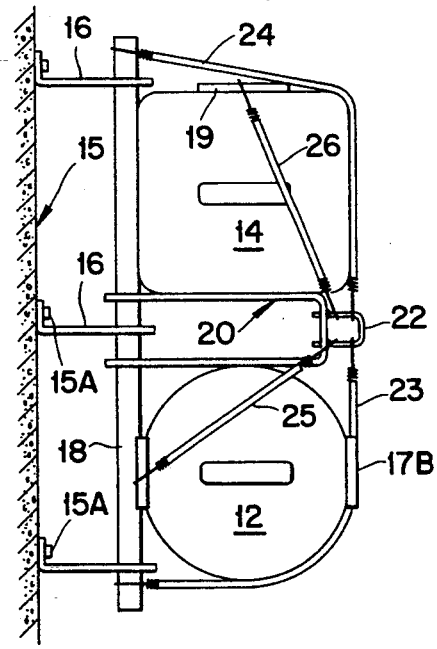
FIG. 2
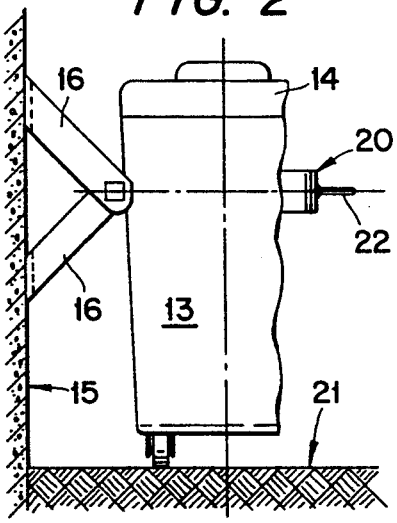
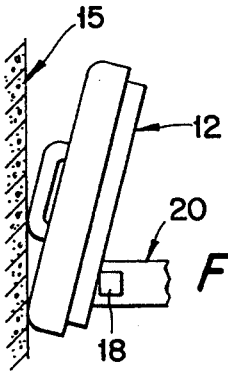
FIG. 4

FIG. 5
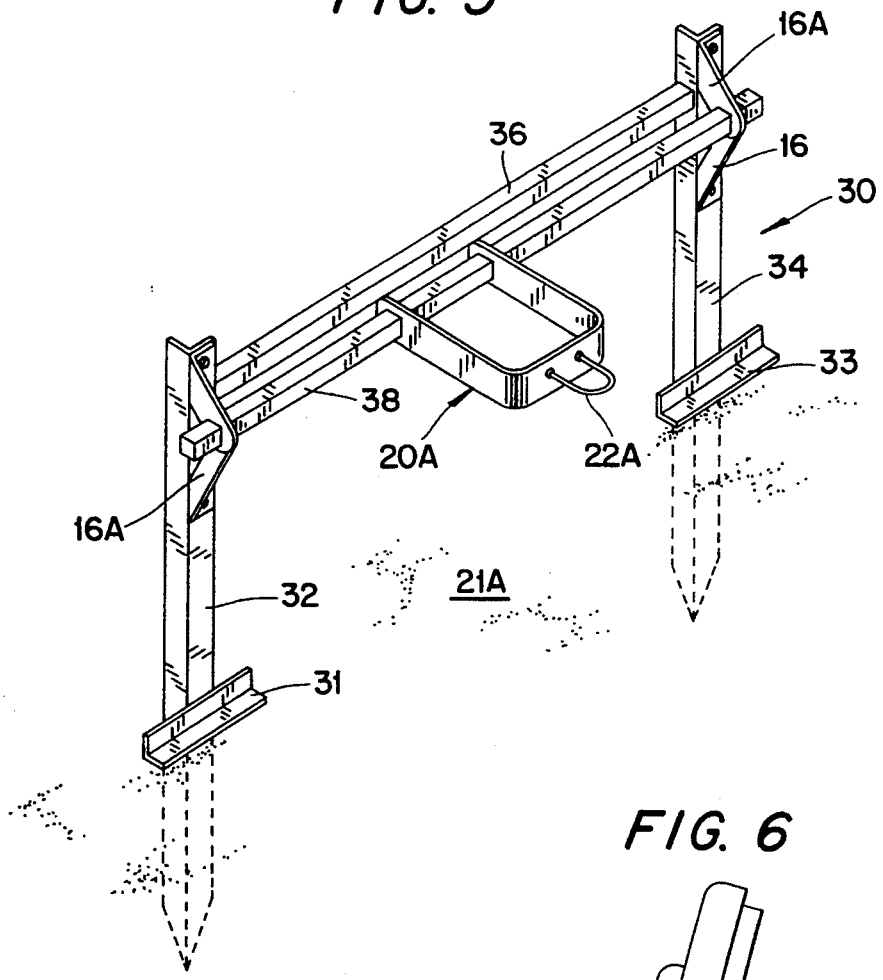
FIG. 6
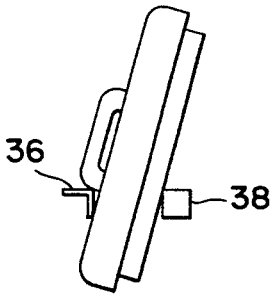
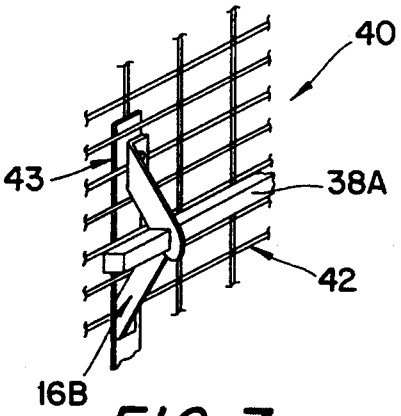
FIG. 7
FIG. 8
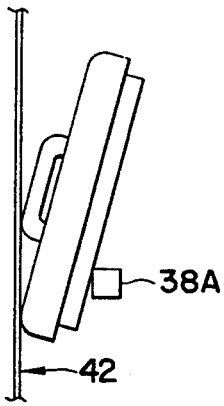

RETAINER ASSEMBLY FOR STABILIZING CONTAINER HAVING A REMOVABLE LID MEMBER

FIELD OF THE INVENTION

This invention relates to an assembly for securing container means in a free upstanding position. More particularly, the assembly of the invention is for retaining a plurality of various shaped containers having removable lid members wherein the containers and cover members are maintained in a stabilized position preventing them from being tipped over and/or uncovered by wind, animals and the like.

BACKGROUND OF THE INVENTION

Numerous U.S. patents are directed to various types of container racks and trash can retaining assemblies to solve the problem of tipping and the uncovering the container contents. The same problem exists for any storage containers used to hold various materials. The invention is specifically to curing the problem regardless of the contents.

U.S. Pat. No. 4,600,109 discloses a garbage can retainer having a series of rigid bars pivotally mounted to a vertically disposed wall section. The entire retainer structure pivotally rotates upwardly and away from the trash cans to allow removal of the lids from the containers that then can also be moved.

U.S. Pat. No. 2,908,396 discloses a container rack that freely fits over the top of a fence and holds two containers at an elevated level above the ground. Receptacle holders designed to accomplish a similar purpose are disclosed in U.S. Pat. Nos. 2,550,019 and 4,473,159.

The utility cart of U.S. Pat. No. 5,040,808 stabilizes similarly shaped receptacles disposed side-by-side with a flexible line attached to the lid so that it cannot be removed from the vicinity of the utility cart.

Various types of racks supporting a plurality of receptacles are shown in U.S. Pat. Nos. 4,527,695; 5,067,626; 5,139,299; and 3,105,594. Each of these structures incorporate a vertically standing structure to which various types of receptacles may be attached. U.S. Pat. No. 3,105,594 discloses use of a flexible line to hold garbage cans in place within the shaped holder mechanism.

U.S. Pat. Nos. 2,865,590; 3,007,664; and 4,487,537 disclose various types of tie-down mechanisms for maintaining removable lid members in a closed position on top of the receptacles.

U.S. Pat. No. 4,854,497 discloses a trash collection unit mounted to a fence and having a flexible line used to bias the door to a closed position.

The manner of solving the targeted problem is not found in the prior art.

PURPOSE OF THE INVENTION

The primary purpose of this invention is to provide an assembly for securing container means in a free upstanding position wherein a removable lid member of the container means is maintained in a closed condition.

Another object of the invention is to provide a retaining assembly for securing a plurality of containers which are not required to be identical but may have varying shapes and sizes.

A further object of the invention is to provide a retainer assembly for a container having a removable lid member using flexible tie-down lines to firmly maintain the container in an upright position and firmly maintain the lid member on the container means to prevent animals and the like from tipping them over and/or removing the lid members to reach the contents of the receptacle.

A still further object of the invention is to provide a retainer assembly that is readily mountable on a vertically disposed wall section, a mesh fence, or on a plurality of posts that may be driven into or otherwise placed in the ground.

SUMMARY OF THE INVENTION

The assembly of this invention includes mounting means for securing rigid outwardly projecting means defining a stabilizing configuration for disposition adjacent container means at a height location below its removably disposed lid member. The outwardly projecting means is effective to maintain the container means in a stabilized upright condition and includes means for connecting first and second flexible tie-down lines at an outer free end line coupling section of the projecting means.

The first flexible tie-down line has a length effective to extend around an outer periphery of the upstanding container means and includes first coupling means for connecting the first flexible line to firmly maintain the container means in the upright position adjacent the stabilizing configuration. The second flexible tie-down line has a length effective to extend over the lid member and includes second coupling means for connecting the second flexible line to firmly maintain the lid member on the container means.

In a particular feature of the invention, the flexible tie-down lines are each composed of elastomeric material. The first tie-down line stretches around a peripheral outer surface of the container means to urge the container means inwardly toward the stabilizing configuration. The second tie-down line stretches over the lid member to urge it toward a closed position on the container means. When both flexible lines are connected in an operating work condition, they effectively bias the container means within a container stabilizing position and the lid members in a closed position on the container means.

In a specific embodiment, the first and second coupling means each having a coupling member disposed at a first end of the respective first and second flexible tie-down lines connected to the outer free end line-coupling section. Elastomeric, flexible lines having a coupling member at both ends are commonly known as bungee holding chords. The coupling members are variously constructed as hooks or as other well known snap-on devices.

The stabilizing configuration of the invention defines a plurality of juxtaposed container stabilizing positions for firmly maintaining a plurality of upstanding container means in an upright position along a horizontally extending surface. The container means may be of differing shapes and sizes so long as the stabilizing configuration is maintained at a height location intermediate the top and bottom of the upstanding container means.

In a specific embodiment mounting means includes rod means having two outer ends with bracket means attached. The bracket means is effective to fix the rod means in a horizontally disposed position. The projecting means is located intermediate the two outer ends of the rod means and defines a container stabilizing position on opposing sides of each projecting means. The bracket means includes fastening means for attaching the mounting means to a vertically disposed mounting support means extending upwardly from a horizontally disposed container supporting surface. That supporting surface may be the ground, concrete sidewalk, floor, or a constructed platform having some other type of fabricated floor.

A specific configuration of the bracket means includes a plurality of hanging support bracket members each having two free bracket-attaching end sections and at least one fastening member for attaching one bracket-attaching end section to the vertically disposed mounting support means. The other bracket-attaching end section includes rod-connecting means for securing at least one elongated rod member at a distance outwardly spaced from the vertically disposed mounting support means. The projecting means includes bracing means having an inner bracing end section coupled to the elongated rod member and carrying the outer free end line-coupling section.

In a specific embodiment, the rod-connecting means of each bracket member and the inner bracing end section of the bracing means each include a rod-receiving opening to slidingly fit over the elongated rod member. The elongated rod member has a shaped outer surface with each rod-receiving opening having a correspondingly shaped circumference to preclude relative rotational movement between the rod member and the circumference of the opening. In a specific embodiment, the shaped outer rod surface and the shaped opening circumference each has a square or rectangular shape.

Another feature of the bracing means includes at least one bracing structure having an inner bracing end section fixedly connected to rod means. The bracing structure projects substantially perpendicularly outwardly from the rod means and includes a means for connecting one end of each flexible line to the outer free end line-coupling section. In a specific embodiment, each bracing structure includes a pair of identically shaped brace elements each having free outer brace end sections and an inner brace end section fixedly connected to the rod means. An outer end linking member joins the free outer brace end sections of each pair of brace elements to form a unified rigid bracing structure. Each flexible line is to be connected to the linking member.

Another feature of the rod means includes elongated rod members disposed a lateral distance outwardly spaced from the vertically disposed support means. The laterally spaced distance is effective to receive a lid member for temporary storage in the space between the rod member and the vertically disposed support means whereby the lid member is in a plane that is transversely disposed with respect to a plane in which the lid member is located when it is in a closed position on the container.

When the vertically disposed support means includes a wall section, the fastening means includes fastening elements such as screws that attach the bracket means to the wall section. When the vertically disposed support means is a mesh fence, the fastening means includes plate sections disposed on opposing sides of the mesh fence with fastening members extending through the plate sections and the mesh fence to secure the mounting means to the mesh fence. When two vertically disposed post members are used, the rod means includes first and second elongated rod members. Each of the two outer ends of both rod members is fixedly secured to a respective one of the support post members. The first elongated rod member is spaced from the second elongated rod member to provide the temporary storage for a lid member.

In a specific embodiment, the bracket means of the invention includes a plurality of identically shaped bracket elements each having an inner end bracket section for being coupled to the rod means and an outer end bracket section for being attached to the vertically disposed support means. Each of the projecting means includes a pair of identically shaped brace elements and a U-shaped link member for connecting the brace elements. The link member provides the means for connecting the first and second flexible tie-down lines used to maintain each container in an upright position and the lid member in a closed position on the top of the container, In another embodiment, the projecting means includes a single one-piece member having a mounting bracket section at each end thereof and at least one generally U-shaped bracing section projecting outwardly from at least one cross-bar section, The cross-bar section is to be mounted for spaced parallel disposition with respect to a vertically disposed mounting support means,

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is a perspective view of an assembly of the invention show in use with two different types of containers having removable lid members.

FIG. 2 is a fragmentary end elevational view of the assembly of FIG. 1;

FIG. 3 is a top plan view of the assembly as shown in FIG. 1;

FIG. 4 is a fragmentary sectional view of an assembly of FIG. 1 showing a lid member stored in a temporary storage space;

FIG. 5 is a perspective view of another embodiment of an assembly made in accordance with the invention;

FIG. 6 is a fragmentary sectional view showing a lid member stored in the embodiment of FIG. 5;

FIG. 7 is a fragmentary perspective view of a further embodiment showing the assembly of the invention connected to a vertically disposed mesh fence;

FIG. 8 is a fragmentary sectional view showing a lid member stored in the embodiment of FIG. 7;

DETAILED DESCRIPTION OF THE INVENTION

Figure 9:
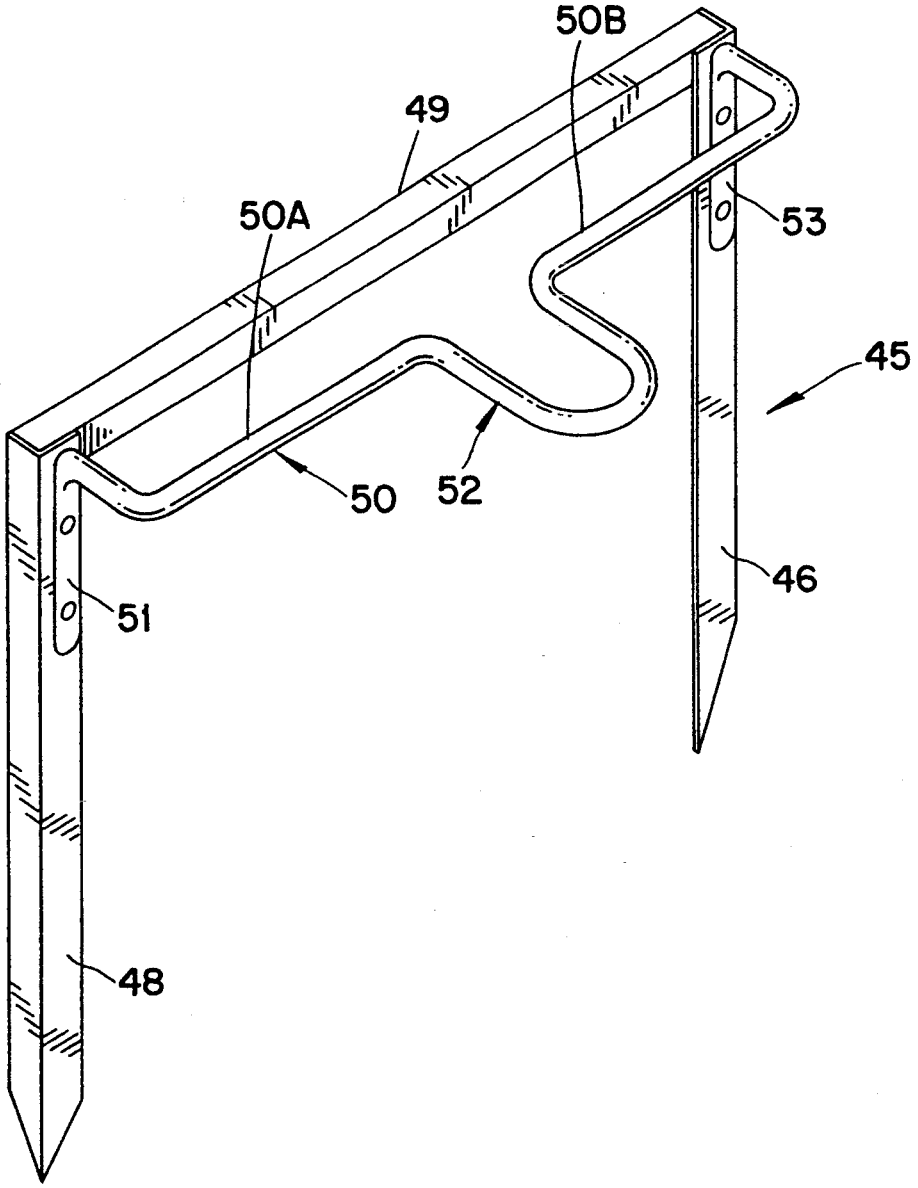
FIG. 9 is a perspective view of a fourth embodiment of an assembly made in accordance with the invention.

The retainer assembly, generally designated 10 in FIG. 1, shows a stabilizing configuration that is effective to maintain the differently shaped containers 11 and 13 in a free upstanding position. The removable lid members 12 and 14 are maintained in a closed position. As shown, the stabilizing configuration defines a plurality of juxtaposed container stabilizing positions for firmly maintaining the containers 11 and 13 in an upright position along the horizontally extending surface 21.

A plurality of hanging support bracket members 16 have two free end bracket-attaching sections as shown. A fastening member 15A secures one bracket-attaching end section to the vertically disposed wall 15. Rod-connecting means at the other end of bracket member 16 includes a rod-receiving opening to slidingly fit over the elongated rod member 18.

As shown in this specific embodiment, the rectangular shape of the rod 18 and the opening in the bracket elements 16 is square. Thus, elongated rod member 18 has a shaped outer surface with each rod-receiving opening having a correspondingly shaped circumference to preclude relative rotational movement between rod members 18 and the circumference of the bracket opening. As shown in FIG. 2, bracket element 16 may be disposed upwardly or downwardly.

The bracing element, generally designated 20 in FIG. 3, is a single generally U-shaped piece having square openings at an inner bracing end section coupled to rod member 18 as shown. The U-shaped link member 22 constitutes an outer free end line-coupling section to which the various flexible tie-down lines 23, 25 and 24, 26 are attached at one end thereof.

Container 11 includes carrying handles 17A and 17B on opposing sides thereof with a removably disposed lid member 12 shown in a closed position on top of container 11. A first flexible tie-down line 23 has a length effective to extend around an outer periphery of upstanding container 11 and includes coupling hooks at either end thereof. One end of line 23 is connected to link member 22 and the other end to rod member 18. Thus, the first flexible line 23 firmly maintains container 11 in an upright position adjacent the stabilizing configuration 10. A rigid outwardly projecting bracing element 20 is disposed adjacent and between containers 11 and 13 at a height location intermediate the top and bottom of the upstanding containers.

The second flexible tie-down line 25 has a length effective to extend over lid member 12 and includes coupling elements at each end thereof. One end connects to linking member 22 and the other end to container handle 17A thereby firmly maintaining lid member 12 on container 11. The first flexible tie-down line 24 and second flexible tie-down line 26 perform the same function for container 13 and lid member 14, respectively as shown. One end of tie-down line 26 is connected to link member 22 and the other end is connected to handle 19 attached to container 13.

When tie-down lines 23, 25 and 24, 26 are composed of elastomeric material, the first tie-down lines 23 and 24 stretch around a peripheral outer surface of the respective containers 11 and 13 in an operating work condition to urge containers 11 and 13 inwardly toward the stabilizing configuration. The second tie-down lines 25 and 26 stretch over respective lid members 12 and 14 in an operating work condition to urge covers 12 and 14 toward a closed position.

In the embodiments of this invention, the elastomeric, flexible lines 23, 25 and 24, 26 have a coupling member at both ends and are commonly known as bungee holding chords. The coupling members are variously constructed as hooks or as other well known snap-on devices. It is contemplated that other types of flexible tie-down lines constructed to perform the same functions may be used instead of the elastomeric tie-down lines disclosed with these specific embodiments.

Bracket elements 16 fix rod member 18 in a horizontally disposed position. The projecting bracing element 20 is located intermediate the two outer ends of rod member 18 and defines a container stabilizing position on opposing sides of element 20. Fastening elements 15A such as screws, attach bracket elements to the wall section 15 that constitutes vertically disposed mounting support means in the embodiment shown in FIGS. 1–4.

The openings of elements 16 constitute rod-connecting means for securing elongated rod member 18 to the bracket-attaching end section so that rod member 18 is at a distance outwardly spaced from wall 15 as shown in FIG. 4. The spaced distance is effective to receive lid member 12 for temporary storage in the space between rod member 18 and wall 15 whereby lid member 12 is in a plane that is transversely disposed with respect to a plane in which the lid member is located when it is in a closed position on container 11.

The assembly, generally designated 30 in FIGS. 5 and 6, includes two vertically disposed support post members 32 and 34 driven into the ground 21A. Abutment members 31 and 32 are welded to post 32 and 34 to limit the depth to which the post 32 and 34 are driven into ground 21A.

First and second elongated rod members 36 and 38 have two outer ends fixedly secured to a respective one of post members 32 and 34. In this embodiment, rod member 36 is welded to posts 32 and 34. Rod member 38 slidingly fits through the rod-receiving opening of elements 16A, which are identically shaped as those of the embodiment shown in FIGS. 1–4. Brace element 20A with linking element 22A are also identical to elements 20 and 22 as shown in the same earlier embodiment.

Elongated rod member 36 is an angle iron and rod member 38 has a square cross-section and are spaced from each other to provide the temporary storage for lid member between rod members 36 and 38 as shown in FIG. 6. Elements 16A are bolted at one end to posts 32 and 34 while the square openings slidingly fit over the outer ends of rod member 38. It is contemplated that rod 38 may have a sufficient length to accommodate more than one brace element 20A so that more than two containers might be maintained in an upstanding position as used with tie-down lines similar to those as described in the earlier embodiment.

The assembly, generally designated 40 in FIGS. 7 and 8, has a horizontally disposed rod 38A laterally spaced from the mesh fence 42. Fastening structure, generally designated 43, includes a plate section on one side of mesh fence 42 with the end plate sections of elements 16B on the other side and disposed parallel to plate section 43. FIG. 8 shows the disposition of a lid member between mesh fence 42 and laterally spaced rod member 38A.

The retainer assembly, generally designated 45 in FIG. 9, discloses the use of two posts 46 and 48 to be driven into the ground. Elongated rod member 49 is fixedly attached at each end to posts 46 and 48. A single, one piece stabilizing configuration member 50 includes mounting bracket sections 51 and 53 at each end thereof. A generally U-shaped bracing section 52 projects outwardly from cross-bar sections 50A and 50B. The cross-bar sections 50A and 50B are mounted in a spaced parallel disposition with respect to vertically disposed posts 46 and 48. The stabilizing configuration member 50 may also be mounted on a wall section or a mesh fence in the same fashion as described with respect to the earlier embodiments.

Four bungee chords (not shown) are used with each bracing element section 52 to retain each pair of containers disposed on either side of bracing element section 52. A plurality of bracing elements 52 could exist in a longer one-piece section. Alternatively, a plurality of assemblies 45 may be disposed in a side-by-side position to accommodate a larger number of container members.

Figure 10:
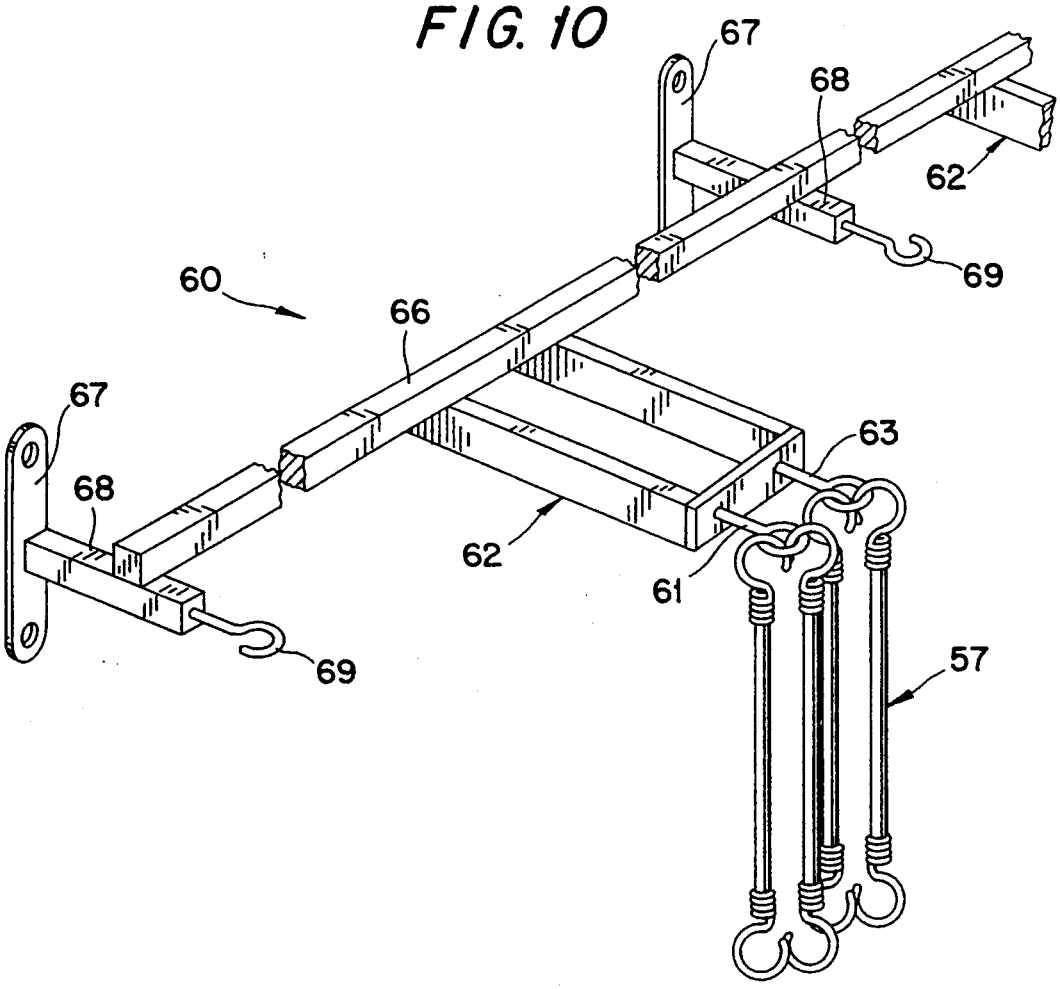
FIG. 10 is a fragmentary perspective view of a fifth embodiment of an assembly having a plurality of projecting brace elements in accord with the invention.

The retainer assembly, generally designated 60 in FIG. 10, has a plurality of bracing elements 62 disposed along an elongated rod member 66. Welded connections join rod member 66 to brackets 68 and bracing element 62. A bolted configuration is also contemplated.

Bracket assemblies 67 may be disposed on a wall section, a mesh fence, or post as disclosed in the earlier embodiments. Hook members 69 disposed at the end of bracket extensions 68 are effective to attach the outer ends of bungee chords 57 around a container disposed within the stabilizing position defined by assembly 60 on either side of bracing elements 62. The other end of the bungee chords 57 are connected to eyebolts 61 and 62 that are fixedly connected to the outer end section of element 62.

Figure 11:
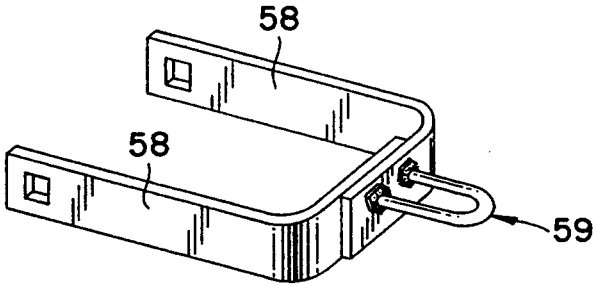
FIG. 11 is another embodiment of a bracing projecting means of the invention.

The bracing element assembly as shown in FIG. 11 includes a pair of identically shaped brace elements 58 with a U-shaped link member 59 connecting the outer ends of brace elements 58 together. Link member 59 provides a means for connecting the first and second flexible tie-down lines as earlier described with respect to the various embodiments disclosed herein.

While the retainer assembly for stabilizing container having a removable lid member has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. An assembly for securing container means in a free upstanding position on a horizontal supporting surface apart from the assembly and wherein the container means has a removable lid member, said assembly comprising:

a) mounting means for securing rigid outwardly projecting means defining a stabilizing configuration for disposition adjacent the container means at a height location intermediate the top and bottom of the upstanding container means, b) said projecting means including a bracing section effective to maintain the container means in a stabilized upright position spaced outwardly from vertically disposed mounting support means, c) the bracing section being adapted to connect first and second flexible tie-down lines at an outer free end of the projecting means, which includes means for connecting the projecting means at an inner end thereof to the vertically disposed mounting support means, d) the first flexible tie-down line having a length effective to extend around an outer periphery of the upstanding container means and including first coupling means for connecting the first flexible line to firmly maintain the container means in said upright position adjacent the projecting means, and e) the second flexible tie-down line having a length effective to extend over the lid member and including second coupling means for connecting the second flexible line to firmly maintain the lid member on the container means.

2. An assembly as defined in claim 1 wherein the first and second coupling means each has a coupling member disposed at a first end of the respective first and second flexible tie-down lines connected to said bracing section at said outer free end, and the projecting means includes a bracing element having the means for connecting the projecting at said inner end thereof and said bracing section projecting outwardly from said means for connecting the projecting said bracing element including a cross-bar section being spaced in parallel disposition with respect to the vertically disposed mounting support means when the assembly is securely mounted to said mounting support means.

3. An assembly as defined in claim 1 wherein the flexible tie-down lines are each composed of elastomeric material, the first tie-down line stretches around a peripheral outer surface of the container means in an operating work condition to urge the container means inwardly toward the bracing section, and the second tie-down line stretches over the lid member in an operating work condition to urge the lid cover toward a closed position on the container means.

4. An assembly as defined in claim 1 wherein the bracing section defines a plurality of juxtaposed container stabilizing positions for firmly maintaining a plurality of upstanding container means in an upright position along said horizontal supporting surface.

5. An assembly as defined in claim 4 wherein the mounting means includes bracket means and rod means having two outer ends, said bracket means is effective to fix the rod means in a horizontally disposed position, and the projecting means includes at least one bracing element located intermediate the two outer ends of the rod means and defines a container stabilizing position on opposing sides of each said bracing element.

6. An assembly as defined in claim 5 wherein the bracket means includes fastening means for attaching the mounting means to said vertically disposed mounting support means that extends upwardly from said horizontal container supporting surface.

7. An assembly for securing container means in a free upstanding position wherein the container means has a removable lid member, said assembly comprising:

a) mounting means for securing rigid outwardly projecting means defining a stabilizing configuration for disposition adjacent the container means at a height location intermediate the top and bottom of the upstanding container means, b) said stabilizing configuration being effective to maintain the container means in a stabilized upright position, c) the projecting means being adapted to connect first and second flexible tie-down lines at an outer free end line-coupling section of the projecting means, d) the first flexible tie-down line having a length effective to extend around an outer periphery of the upstanding container means and including first coupling means for connecting the first flexible line to firmly maintain the container means in said upright position adjacent the stabilizing configuration, e) the second flexible tie-down line having a length effective to extend over the lid member and including second coupling means for connecting the second flexible line to firmly maintain the lid member on the container means, f) the stabilizing configuration defines a plurality of juxtaposed container stabilizing positions for firmly maintaining a plurality of upstanding container means in an upright position along a horizontally extending surface, g) the mounting means includes bracket means and rod means having two outer ends, h) said bracket means is effective to fix the rod means in a horizontally disposed position, i) the projecting means is located intermediate the two outer ends of the rod means and defines a container stabilizing position on opposing sides of each projecting means, j) the rod means includes at least one elongated rod member, k) the bracket means includes a plurality of hanging support bracket members each having two free end bracket-attaching sections, rod-connecting means, and at least one fastening member for attaching the mounting means to vertically disposed mounting support means that extends upwardly from a horizontally disposed container supporting surface, l) the fastening member is for securing one bracket-attaching end section to the vertically disposed mounting support means, m) the rod-connecting means secures the elongated rod member to the other bracket-attaching end section so that the rod member is at a spaced distance outwardly from the vertically disposed mounting support means, and n) the projecting means includes bracing means having an inner bracing end section coupled to the elongated rod member and carrying said outer free end line-coupling section.

8. An assembly as defined in claim 7 wherein the rod-connecting means at the bracket-attaching end section of each bracket member and the inner bracing end section of the bracing means each include a rod-receiving opening to slidingly fit over the elongated rod member, the elongated rod member having a shaped outer surface with each rod-receiving opening having a correspondingly shaped circumference to preclude relative rotational movement between the rod member and circumference of the opening.

9. An assembly as defined in claim 8 wherein the shaped outer rod surface and the shaped opening circumference each has a rectangular shape.

10. An assembly as defined in claim 1 wherein the mounting means includes horizontally disposed rod means, and the bracing section has an inner bracing end section coupled to the rod means and carries said outer free end.

11. An assembly as defined in claim 10 wherein the bracing section includes at least one bracing structure having an inner bracing end section fixedly connected to the rod means and projecting substantially perpendicularly outwardly from the rod means, and the bracing structure includes means for connecting at least one end of each flexible tie-down line to the outer free end.

12. An assembly for securing container means in a free upstanding position wherein the container means has a removable lid member, said assembly comprising:

a) mounting means for securing rigid outwardly projecting means defining a stabilizing configuration for disposition adjacent the container means at a height location intermediate the top and bottom of the upstanding container means, b) said stabilizing configuration being effective to maintain the container means in a stabilized upright position, c) the projecting means being adapted to connect first and second flexible tie-down lines at an outer free end line-coupling section of the projecting means, d) the first flexible tie-down line having a length effective to extend around an outer periphery of the upstanding container means and including first coupling means for connecting the first flexible line to firmly maintain the container means in said upright position adjacent the stabilizing configuration, e) the second flexible tie-down line having a length effective to extend over the lid member and including second coupling means for connecting the second flexible line to firmly maintain the lid member on the container means, f) the mounting means includes horizontally disposed rod means, g) the projecting means includes bracing means having an inner bracing end section coupled to the rod means and carrying the outer free end line-coupling section.

h) the bracing means includes at least one bracing structure having an inner bracing end section fixedly connected to the rod means and projecting substantially perpendicularly outwardly from the rod means, i) the bracing structure includes the means for connecting one end of each flexible tie-down line to the outer free end line-coupling section, j) each bracing structure includes a pair of identically shaped brace elements each having a free outer brace end section and an inner brace end section fixedly connected to the rod means, and k) said means for connecting each flexible tie-down line includes an outer end linking member that joins the free outer brace end sections of each pair of brace elements to form a unified rigid bracing structure.

13. An assembly as defined in claim 1 wherein the mounting means includes fastening means for attaching the bracing section to said vertically disposed mounting support means extending upwardly from said horizontal supporting surface, and the vertically disposed mounting support means is selected from the group consisting of a wall, a mesh fence, and a plurality of support posts.

14. An assembly for securing container means in a free upstanding position wherein the container means has a removable lid member, said assembly comprising:

a) mounting means for securing rigid outwardly projecting means defining a stabilizing configuration for disposition adjacent the container means at a height location intermediate the top and bottom of the upstanding container means, b) said stabilizing configuration being effective to maintain the container means in a stabilized upright position, c) the projecting means being adapted to connect first and second flexible tie-down lines at an outer free end line-coupling section of the projecting means, d) the first flexible tie-down line having a length effective to extend around an outer periphery of the upstanding container means and including first coupling means for connecting the first flexible line to firmly maintain the container means in said upright position adjacent the stabilizing configuration, e) the second flexible tie-down line having a length effective to extend over the lid member and including second coupling means for connecting the second flexible line to firmly maintain the lid member on the container means, f) the mounting means includes fastening means for attaching the mounting means to vertically disposed mounting support means extending upwardly from a horizontally disposed container supporting surface, g) the vertically disposed mounting support means is selected from the group consisting of a wall, a mesh fence, and a plurality of support posts, h) the mounting means includes bracket means and rod means having two outer ends, i) said bracket means fixes the rod means in a horizontally disposed position with the projecting means defining a plurality of container stabilizing positions along the container supporting surface.

15. An assembly as defined in claim 14 wherein the rod means includes an elongated rod member fixedly disposed a spaced distance outwardly from the vertically disposed support means, said spaced distance being effective to receive a lid member for temporary storage in the space between the rod member and the vertically disposed support means whereby the lid member is in a plane that is transversely disposed with respect to a plane in which the lid member is located when it is in a closed position on the container means.

16. An assembly as defined in claim 15 wherein the vertically disposed support means includes a wall section, and the fastening means includes fastening elements that attach the bracket means to the wall section.

17. An assembly as defined in claim 15 wherein the vertically disposed support means is a mesh fence, and the fastening means includes plate sections disposed on opposing sides of the mesh fence with fastening members extending through the plate sections and the mesh fence to secure the mounting means to the mesh fence.

18. An assembly as defined in claim 14 wherein the vertically disposed support means includes two vertically disposed support post members, and the rod means includes a first and second elongated rod member each having two outer ends fixedly secured to a respective one of the support post members, said first elongated rod member being spaced from the second elongated rod member to provide temporary storage for a lid member between the rod members.

19. An assembly as defined in claim 14 wherein the bracket means includes a plurality of identically shaped bracket elements each having an inner end bracket section for being coupled to the rod means and an outer end bracket section for being attached to the vertically disposed support means.

20. An assembly for securing container means in a free upstanding position wherein the container means has a removable lid member, said assembly comprising:

a) mounting means for securing rigid outwardly projecting means defining a stabilizing configuration for disposition adjacent the container means at a height location intermediate the top and bottom of the upstanding container means, b) said stabilizing configuration being effective to maintain the container means in a stabilized upright position, c) the projecting means being adapted to connect first and second flexible tie-down lines at an outer free end line-coupling section of the projecting means, d) the first flexible tie-down line having a length effective to extend around an outer periphery of the upstanding container means and including first coupling means for connecting the first flexible line to firmly maintain the container means in said upright position adjacent the stabilizing configuration, e) the second flexible tie-down line having a length effective to extend over the lid member and including second coupling means for connecting the second flexible line to firmly maintain the lid member on the container means, f) each projecting means includes a pair of identically shaped brace elements and a U-shaped link member for connecting the brace elements, and g) said link member providing the means for connecting the first and second flexible tie-down lines.

* * * * *